US011555368B2

(12) United States Patent
Ghamdi et al.

(10) Patent No.: US 11,555,368 B2
(45) Date of Patent: Jan. 17, 2023

(54) JUNK RECOVERY TOOLS AND SYSTEMS AND METHODS OF COLLECTING JUNK

(71) Applicant: Saudi Arabian Oil Company, Dhahran (SA)

(72) Inventors: Ibrahim Ghamdi, Dhahran (SA); Ossama R. Sehsah, Dhahran (SA); Mahmoud Adnan Alqurashi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/334,034

(22) Filed: May 28, 2021

(65) Prior Publication Data

US 2022/0381103 A1 Dec. 1, 2022

(51) Int. Cl.

| | |
|---|---|
| ***E21B 31/08*** | (2006.01) |
| ***E21B 27/00*** | (2006.01) |
| ***E21B 4/02*** | (2006.01) |

(52) U.S. Cl.

CPC ..... *E21B 31/08* (2020.05); *E21B 4/02* (2013.01); *E21B 27/005* (2013.01)

(58) Field of Classification Search

CPC ..... E21B 31/08; E21B 27/00; E21B 31/00; E21B 27/005

See application file for complete search history.

(56) References Cited

U.S. PATENT DOCUMENTS

| | | | | |
|---|---|---|---|---|
| 2,708,566 | A * | 5/1955 | Caldwell | E21B 4/04 175/102 |
| 3,500,933 | A * | 3/1970 | Burba, Jr. | E21B 37/00 166/311 |
| 6,176,311 | B1 * | 1/2001 | Ryan | E21B 21/002 166/99 |
| 7,753,113 | B1 | 7/2010 | Penisson | |
| 8,453,724 | B2 | 6/2013 | Zhou | |
| 10,400,554 | B2 * | 9/2019 | Mericas | E21B 21/002 |
| 10,533,400 | B2 * | 1/2020 | Rogers | B01D 17/045 |
| 11,286,732 | B1 * | 3/2022 | Teodorescu | E21B 43/086 |
| 2003/0150616 | A1 * | 8/2003 | Mashburn | E21B 27/005 166/311 |

(Continued)

FOREIGN PATENT DOCUMENTS

WO 2008127836 A1 10/2008

*Primary Examiner* — Blake Michener

(74) *Attorney, Agent, or Firm* — Dinsmore & Shohl, LLP

(57) ABSTRACT

A junk recovery tool may include a longitudinal axial mandrel, a plurality of junk recovery baskets, and at least one junk recovery sensor. The plurality of junk recovery baskets may be spaced apart and attached to the longitudinal axial mandrel. A first one of the junk recovery baskets may be disposed uphole of a second one of the junk recovery baskets. Each of the junk recovery baskets may include a plurality of apertures, allowing a drilling fluid to pass through the junk recovery basket while collecting junk from the drilling fluid. The at least one junk recovery sensor may be disposed in one of the plurality of junk recovery baskets. The at least one junk recovery sensor may be operable to measure an amount of collected junk in the one of the plurality of junk recovery baskets. The present disclosure also includes systems and methods incorporating the junk recovery tool.

18 Claims, 3 Drawing Sheets

(56) References Cited

U.S. PATENT DOCUMENTS

| | | | | |
|---|---|---|---|---|
| 2006/0213667 | A1* | 9/2006 | Mashburn | E21B 21/002 166/227 |
| 2007/0272404 | A1* | 11/2007 | Lynde | E21B 27/005 166/99 |
| 2009/0322030 | A1 | 12/2009 | Pallini, Jr. et al. | |
| 2013/0341027 | A1* | 12/2013 | Xu | E21B 27/005 166/99 |
| 2015/0321125 | A1* | 11/2015 | Jenkins | B01D 29/112 210/435 |
| 2015/0345276 | A1* | 12/2015 | Jensen | E21B 27/00 166/105.3 |
| 2016/0168939 | A1* | 6/2016 | Harris | E21B 27/005 166/250.01 |
| 2017/0328158 | A1* | 11/2017 | Hanson | E21B 27/005 |
| 2019/0316443 | A1* | 10/2019 | Haugland | E21B 27/02 |

* cited by examiner

JUNK RECOVERY TOOLS AND SYSTEMS AND METHODS OF COLLECTING JUNK

BACKGROUND

The present disclosure relates to drilling tools and, more specifically, to tools, systems, and methods for collecting junk in a drilling fluid.

BRIEF SUMMARY

During drilling and workover of wells, junk and other debris may be present in the drilling muds being used in the wellbores. It may be desirable to concentrate and/or catch the junk and other debris in the wellbores to avoid numerous issues that may arise from the presence of this junk or other debris. For example, this junk and other debris may cause stuck tail pipes, damage to the wells, or damage to the reservoirs these wells are in. Accordingly, there is an ongoing need for tools, systems, and methods that effectively and efficiently concentrate and catch the junk and debris in the drilling muds being used in wellbores. As further discussed herein, embodiments of the present disclosure meet this need and enhance clean out operations in wells.

According to one or more aspects of the present disclosure, a junk recovery tool for a wellbore may include a longitudinal axial mandrel, a plurality of junk recovery baskets, and at least one junk recovery sensor. The plurality of junk recovery baskets may be spaced apart and attached to the longitudinal axial mandrel. A first one of the junk recovery baskets may be disposed uphole of a second one of the junk recovery baskets. Each of the junk recovery baskets may include a plurality of apertures to allow a drilling fluid to pass through the junk recovery basket while collecting junk from the drilling fluid. The plurality of apertures may each have an opening size. The plurality of apertures of the first one of the junk recovery baskets may have a different opening size than the plurality of apertures of the second one of the junk recovery baskets. The at least one junk recovery sensor may be disposed in one of the plurality of junk recovery baskets. The at least one junk recovery sensor may be operable to measure an amount of collected junk in the one of the plurality of junk recovery baskets.

According to one or more other aspects of the present disclosure, a system for recovering junk in a wellbore may include a drilling tool and a junk recovery tool. The drilling tool may include a drilling fluid source, a drill string, and a drill bit. The drilling tool may have a length and the drill bit may define a downhole end of the length of the drilling tool. The drilling fluid source may be operable to store a drilling fluid. The drill string may include a drilling tool longitudinal axial mandrel extending the length of the drill string. The drill string may couple the drilling fluid source to the drill bit. The drill string may be operable to transport the drilling fluid stored in the drilling fluid source along the drilling tool longitudinal axial mandrel to the drill bit. The junk recovery tool may include a longitudinal axial mandrel, a plurality of junk recovery baskets and at least one junk recovery sensor. The junk recovery tool may be positioned along the drill string and above the drill bit. The drilling tool longitudinal axial mandrel of the drill string may be in fluid communication with the longitudinal axial mandrel of the junk recovery tool. The plurality of junk recovery baskets may be spaced apart and attached to the longitudinal axial mandrel of the junk recovery tool. A first one of the junk recovery baskets may be disposed uphole of a second one of the junk recovery baskets. Each of the plurality of junk recovery baskets may have a plurality of apertures to allow the drilling fluid to pass through the junk recovery baskets while collecting junk from the drilling fluid. The plurality of apertures may each have an opening size. The plurality of apertures of the first one of the junk recovery baskets may have a differing opening size than the plurality of apertures of the second one of the junk recovery baskets. The at least one junk recovery sensor may be disposed in one of the plurality of junk recovery baskets. The at least one junk recovery sensor may be operable to measure an amount of collected junk in the one of the plurality of junk recovery baskets.

According to one or more other aspects of the present disclosure, a method for recovering junk in a wellbore may include circulating a drilling fluid comprising junk through a junk recovery tool and passing at least a portion of the drilling fluid comprising junk through a plurality of junk recovery baskets spaced apart and attached to a longitudinal axial mandrel of the junk recovery tool. A first one of the junk recovery baskets may be disposed uphole of a second one of the junk recovery baskets. Each of the junk recovery baskets may include a plurality of apertures. The apertures may each have an opening size. The plurality of apertures of the first one of the junk recovery baskets may have a different opening size than the plurality of apertures of the second one of the junk recovery baskets. The method may also include filtering at least a portion of junk from the drilling fluid as the drilling fluid passes through the plurality of junk recovery baskets of the junk recovery tool.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

The present disclosure is directed to tools, systems, and methods for collecting junk. Conventional junk recovery tools may not efficiently collect junk from drilling fluid and may require tripping out of the wellbore to monitor a status of the junk recovery tool. Embodiments of the present disclosure meet a demand for more efficient tools, systems, and methods for collecting junk. The tools, systems, and methods for collecting junk of the present disclosure include a plurality of junk recovery baskets having different-sized apertures for collecting junk of various sizes, which may allow the junk recovery tool to filter the junk being collected by size. Embodiments of the present disclosure, as further described herein, also avoid the need for guesswork of whether the junk recovery tool is full and can continue to collect junk until the junk recovery tool is full.

Junk recovery tools of the present disclosure may be integrated with other tools present during drilling and workover operations. For example, the junk recovery tool may be present on a drilling bottom hole assembly, a workover bottom hole assembly (BHA), or a completion assembly.

As used in the present disclosure, "junk" may refer to anything in the wellbore that is not supposed to be there, such as small pieces of steel (e.g., hand tools, small parts, bit nozzles, pieces of bits or other downhole tools, and remnants of milling operations, etc.).

As used in the present disclosure, "wellbore" may refer to a drilled hole or borehole, including an openhole or uncased portion of the well, where "borehole" may refer to the inside diameter of the wellbore wall (i.e., the rock face that bounds the drilled hole).

Figure 1:
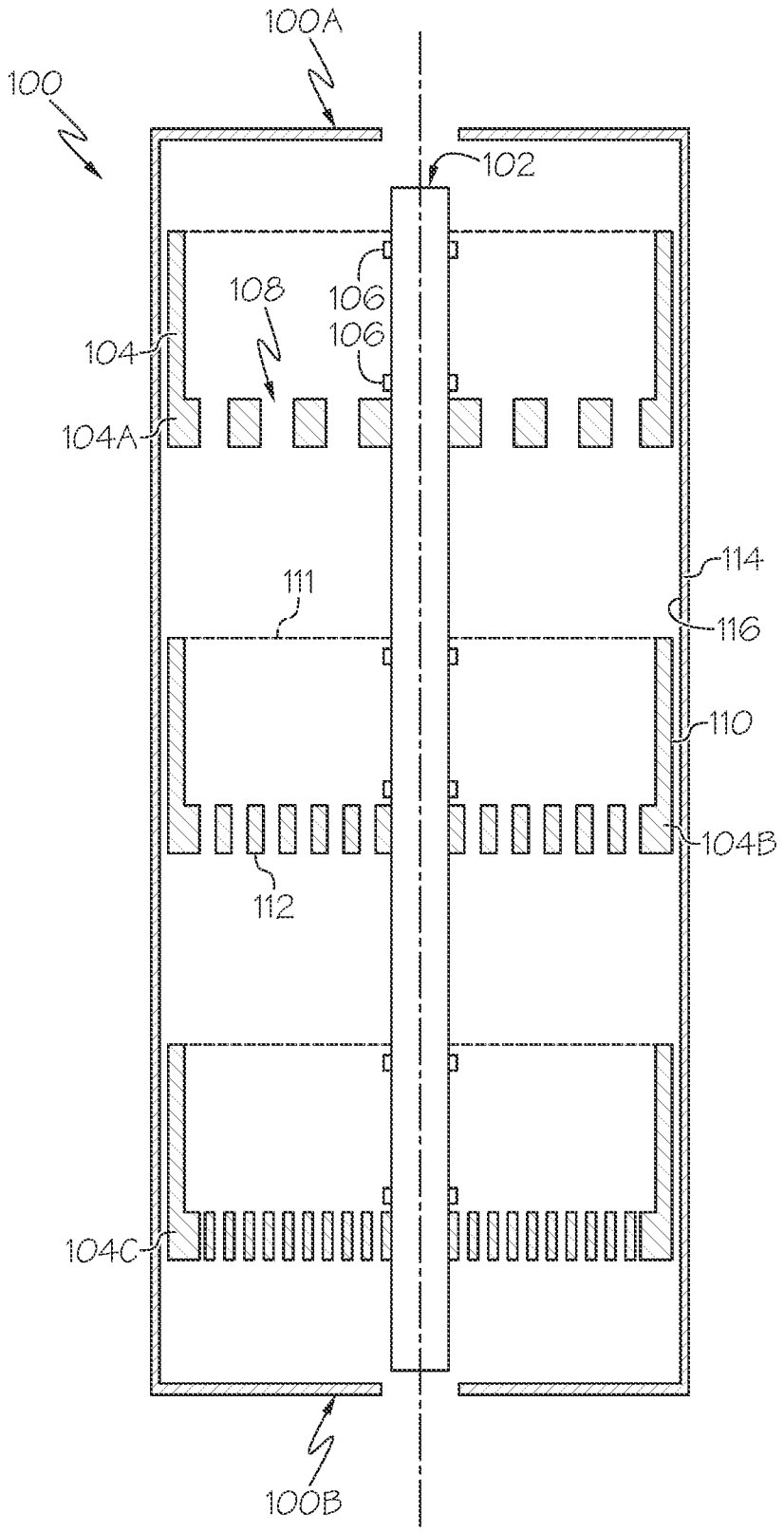
FIG. 1 schematically depicts a cross-sectional view of a junk recovery tool in accordance with one or more embodiments of the present disclosure.
Figure 2:
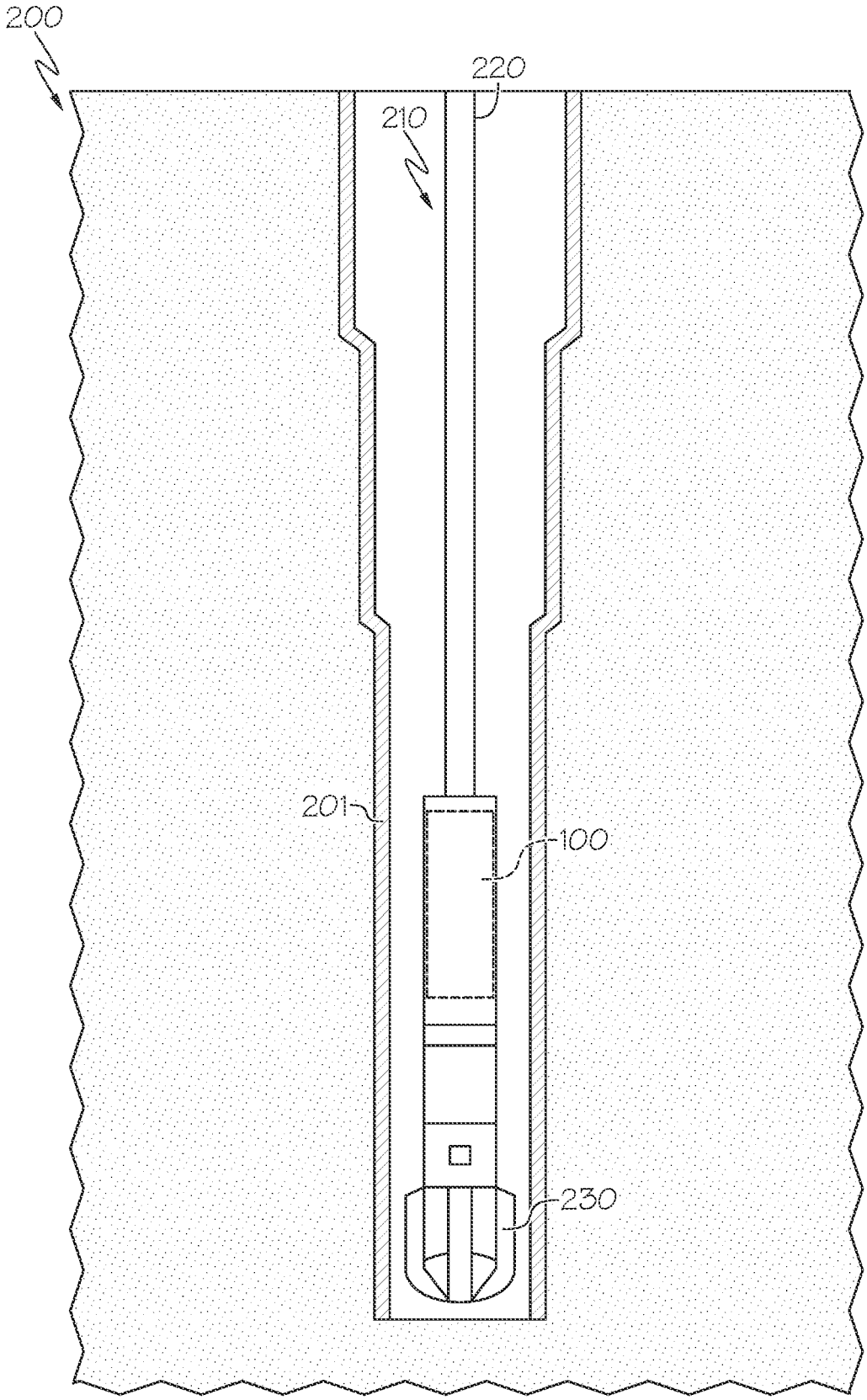
FIG. 2 schematically depicts a drilling tool and a junk recovery tool in accordance with one or more embodiments of the present disclosure.

Referring initially to FIGS. 1 and 2, a junk recovery tool 100 for a wellbore 201 may include a longitudinal axial mandrel 102, a plurality of junk recovery baskets 104, and at least one junk recovery sensor 106. The plurality of junk recovery baskets 104 may be spaced apart and attached to the longitudinal axial mandrel 102. A first one 104A of the junk recovery baskets 104 may be disposed uphole of a second one 104B of the junk recovery baskets 104. Each of the junk recovery baskets 104 may include a plurality of apertures 108 to allow a drilling fluid to pass through the junk recovery basket 104 while collecting junk from the drilling fluid. The plurality of apertures 108 may each have an opening size. The plurality of apertures 108 of the first one 104A of the junk recovery baskets 104 may comprise a different opening size than the plurality of apertures 108 of the second one 104B of the junk recovery baskets 104. The at least one junk recovery sensor 106 may be disposed in one of the plurality of junk recovery baskets 104 and may be operable to measure an amount of collected junk in the one of the plurality of junk recovery baskets 104.

Referring to FIG. 1, the longitudinal axial mandrel 102 may be a bar, shaft, or spindle around which other components, such as the plurality of junk recovery baskets 104, are assembled. The longitudinal axial mandrel 102 may extend from at or near an uphole end 100A of the junk recovery tool 100 to at or near a downhole end 100B of the junk recovery tool 100.

The plurality of junk recovery baskets 104 may include an outer wall 110, at least a partially open top 111, and a bottom 112. At least a portion of the plurality of apertures 108 may be defined in the bottom 112 of the plurality of junk recovery baskets 104.

It is contemplated that any number of junk recovery baskets 104 may be used in the junk recovery tool 100. The junk recovery tool 100 may comprise three, four, five, seven, ten, or more junk recovery baskets 104. In embodiments where the junk recovery tool 100 comprises more than two junk recovery baskets 104, a third one 104C of the junk recovery baskets 104 may be disposed downhole of the first one 104A of the junk recovery baskets 104 and uphole of the second one 104B of the junk recovery baskets 104. The plurality of apertures 108 of the third one 104C of the junk recovery baskets 104 may comprise a smaller opening size than the first one 104A of the junk recovery baskets 104 and a larger opening size than the second one 104B of the junk recovery baskets 104.

The plurality of apertures 108 may allow a drilling fluid to pass through the junk recovery basket 104 while collecting junk from the drilling fluid. It is contemplated that many different embodiments with varying aperture 108 configurations may be used. For example, the plurality of apertures 108 of individual ones of the plurality of junk recovery baskets 104 may comprise a uniform opening size. Alternatively, the plurality of apertures 108 of individual ones of the plurality of junk recovery baskets 104 may comprise a non-uniform opening size. That is, the plurality of apertures 108 of one junk recovery basket 104 may comprise various opening sizes.

In embodiments, the plurality of apertures 108 may be round openings. The round openings may have a diameter. The diameter of the plurality of apertures 108 may range from greater than or equal to 0.03125 inches (0.08 centimeters) to less than or equal to 2 inches (5 centimeters). For example, in an embodiment having three junk recovery baskets 104, the most uphole junk recovery basket 104 (e.g., the first one 104A of the junk recovery baskets 104) may have an opening size of 0.5 inches (1.3 centimeters), the most downhole junk recovery basket 104 (e.g., the second one 104B of the junk recovery baskets 104) may have an opening size of 0.125 inches (0.3 centimeters), and a junk recovery basket 104 between the most uphole junk recovery basket 104 and the most downhole junk recovery basket 104 (e.g., the third one 104C of the junk recovery baskets 104) may have an opening size of 0.25 inches (0.6 centimeters).

The at least one junk recovery sensor 106 may include a weight sensor, a level sensor, or both. A weight sensor may refer to any sensor that is operable to determine the weight of junk collected in a junk recovery basket 104. The weight sensor may determine the volume of the junk collected in a junk recovery basket 104. A level sensor may refer to any sensor that is operable to detect the amount of junk (such as through a plane of the uppermost junk) collected in a junk recovery basket 104. The level sensor may detect the volume of the junk collected in a junk recovery basket 104. The at least one junk recovery sensor 106 may be a fluid-type sensor. The fluid-type sensor may determine the type of fluid in the one of the plurality of junk recovery baskets 104. The fluid-type sensor may determine the type of fluid based on the pressure and density of the fluid. The at least one junk recovery sensor 106 may monitor the weight or level of junk in the junk recovery basket 104. The at least one junk recovery sensor 106 may transmit information to the surface to provide the status of the junk recovery basket 104, such as if cleaning is required.

In embodiments, the at least one junk recovery sensor 106 comprises a weight sensor positioned at or near the bottom 112 of the plurality of junk recovery baskets 104. The weight sensor may measure an amount of junk collected in one of the plurality of junk recovery baskets 104. In embodiments, the at least one junk recovery sensor 106 comprises a level sensor positioned at or near the top 111 of the plurality of junk recovery baskets 104. The level sensor may measure an amount of junk collected in one of the plurality of junk recovery baskets 104.

Referring again to FIGS. 1 and 2, it is contemplated that the junk recovery tool 100 may include multiple different types of sensors and/or multiple sensors in different locations (such as, in different ones of the plurality of junk recovery baskets 104). In embodiments, the junk recovery tool 100 for the wellbore 201 may include a first junk recovery sensor 106 disposed in the first one 104A of the junk recovery baskets 104 and a second junk recovery sensor 106 disposed in the second one 104B of the junk recovery baskets 104. The junk recovery tool 100 for the wellbore 201 may include a plurality of junk recovery sensors 106 disposed in each of the plurality of junk recovery baskets 104. In embodiments where a plurality of junk recovery sensors 106 are disposed in each of the plurality of junk recovery baskets 104, each of the plurality of junk recovery sensors 106 may measure different things (e.g., one weight sensor, one level sensor, one fluid-type sensor, etc.)

In other embodiments, the junk recovery tool 100 may include a single junk recovery sensor 106 in one of the plurality of junk recovery baskets 104. In embodiments, the junk recovery tool 100 may include a single junk recovery sensor 106 in the junk recovery basket 104 that may collect the most junk. The junk recovery basket 104 that may collect the most junk may vary based on the drilling fluid and/or chemicals being used, or other characteristics of the drilling operation.

In embodiments, the junk recovery tool 100 may include an outer housing 114. An inner surface 116 of the outer housing 114 may be in direct contact with each of the outer walls of the plurality of junk recovery baskets 104. The outer housing 114 may be operable to contain a drilling fluid being passed through the plurality of junk recovery baskets 104 of the junk recovery tool 100 within the junk recovery tool 100. The outer housing 114 may comprise an outer profile that is complementary to the wellbore 201.

The junk recovery tool 100 may be integrated with other tools present during drilling and workover operations. For example, the junk recovery tool 100 may be present on a drilling bottom hole assembly, a workover bottom hole assembly (BHA), or a completion assembly.

The present disclosure is also directed to systems 200 for recovering junk in a wellbore 201. Referring to FIG. 2, a system 200 for recovering junk in a wellbore 201 is schematically depicted. The system 200 may include a drilling tool 210 and a junk recovery tool 100. The drilling tool 210 may include a drilling fluid source (not shown), a drill string 220, and a drill bit 230. The drilling tool 210 may comprise a length and the drill bit 230 may define a downhole end of the length of the drilling tool 210. The drilling fluid source may be operable to store a drilling fluid. The drill string 210 may include a drilling tool longitudinal axial mandrel extending the length of the drill string 210. The drill string 210 may couple the drilling fluid source to the drill bit 230 and may be operable to transport the drilling fluid stored in the drilling fluid source along the drilling tool longitudinal axial mandrel to the drill bit 230.

The details of the junk recovery tool 100 for the system 200 are shown in FIG. 1. The junk recovery tool 100 may include a longitudinal axial mandrel 102, a plurality of junk recovery baskets 104 and at least one junk recovery sensor 106. The junk recovery tool 100 may be positioned along the drill string 210 and above the drill bit 230. The plurality of junk recovery baskets 104 may be spaced apart and may be attached to the longitudinal axial mandrel 102 of the junk recovery tool 100. A first one 104A of the junk recovery baskets 104 may be disposed uphole of a second one 104B of the junk recovery baskets 104. Each of junk recovery baskets 104 may comprise a plurality of apertures 108 to allow the drilling fluid to pass through the junk recovery baskets 104 while collecting junk from the drilling fluid. The plurality of apertures 108 may each have an opening size. The plurality of apertures 108 of the first one 104A of the junk recovery baskets 104 may comprise a differing opening size than the plurality of apertures 108 of the second one 104B of the junk recovery baskets 104. The at least one junk recovery sensor 106 may be disposed in one of the plurality of junk recovery baskets 104 and may be operable to measure an amount of collected junk in the one of the plurality of junk recovery baskets 104.

The drill bit 230 of the drilling tool 210 may include any conventional or yet-to-be developed drill bit. For example, the drill bit 230 may be a drill bit 230 used for drilling or milling.

The junk recovery tool 100 employed in the system 200 for recovering junk in a wellbore 201 may include any feature, function, or characteristic as previously described in the present disclosure.

Figure 3:
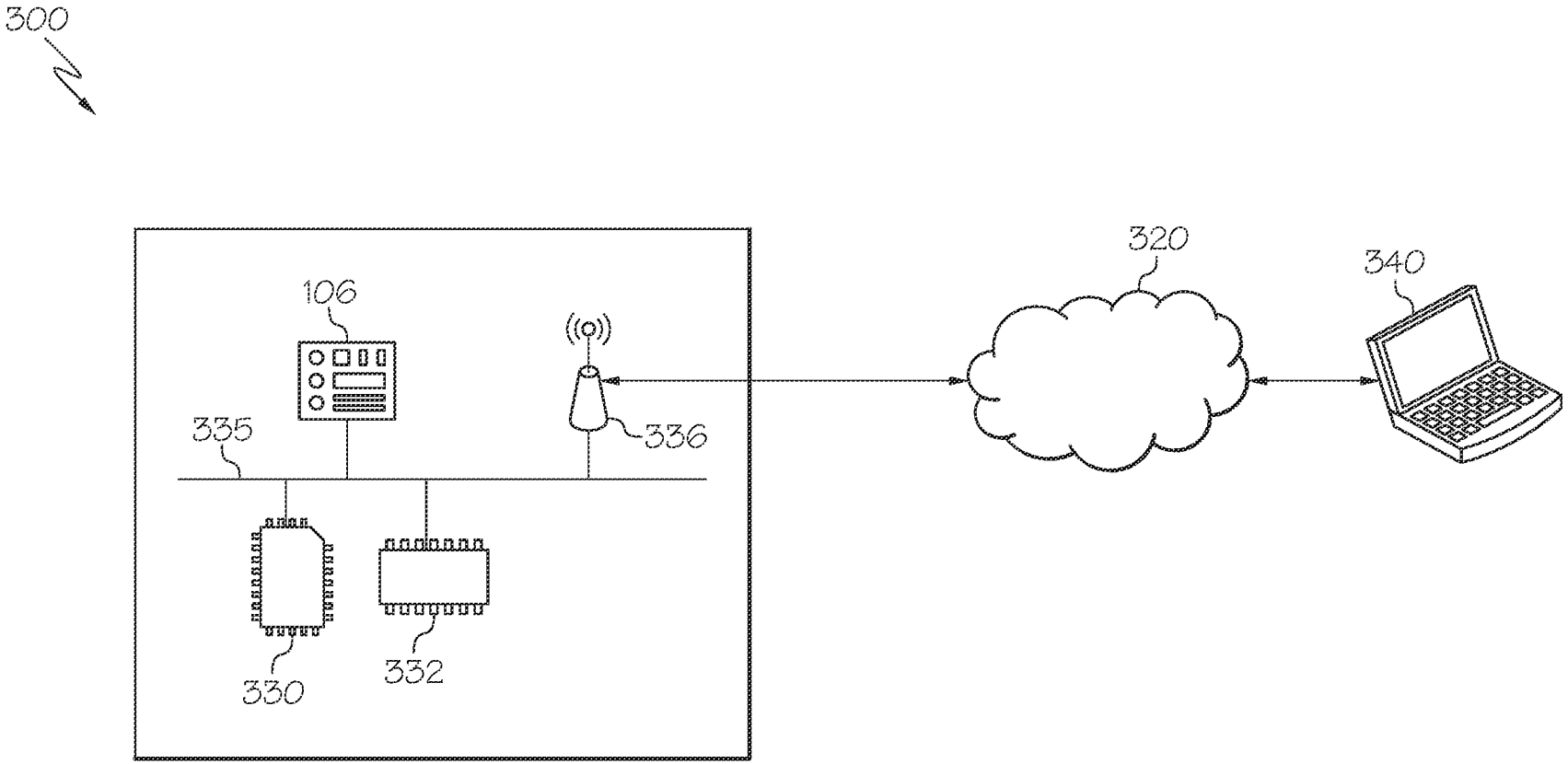
FIG. 3 schematically depicts a detection system that includes at least one junk recovery sensor in accordance with one or more embodiments shown and described in this disclosure.

Referring now to FIG. 3, a detection system 300 may be provided for operating the junk recovery tool 100. The detection system 300 includes the at least one junk recovery tool sensor 106, as well as a processor 330, a non-transitory electronic memory 332, and a communication path 335 that communicatively couples the plurality of components of the detection system 300.

In some embodiments, the processor 330 and the non-transitory electronic memory 332 and/or the other components are included within or on a single device, such as the junk recovery tool 100. In other embodiments, the processor 330 and the non-transitory electronic memory 332 and/or the other components may be distributed among multiple devices that are communicatively coupled, such as various locations along the drill string 210. The non-transitory electronic memory 332 stores a set of machine-readable instructions. The processor 330 executes the machine-readable instructions stored in the non-transitory electronic memory 332. The non-transitory electronic memory 332 may comprise RAM, ROM, flash memories, hard drives, or any device capable of storing machine-readable instructions such that the machine-readable instructions can be accessed by the processor 330. Accordingly, the detection system 300 described herein may be implemented in any conventional computer programming language, as pre-programmed hardware elements, or as a combination of hardware and software components. The non-transitory electronic memory 332 may be implemented as one memory module or a plurality of memory modules.

In some embodiments, the non-transitory electronic memory 332 includes instructions for executing the functions of the detection system 300. The instructions may include instructions for operating the at least one junk recovery sensor 106, for example, instructions regarding a pressure for the at least one junk recovery sensor 106 to detect or any other operational instructions.

In embodiments, the non-transitory electronic memory 332 may include instructions for the at least one junk recovery sensor 106 to detect a specific pressure in the junk recovery tool 100. The non-transitory electronic memory 332 may include instructions for the at least one junk recovery sensor 106 to detect various pressure thresholds in the junk recovery tool 100. For example, if a first threshold is detected, it may be evidence that the junk recovery tool 100 is working properly and collecting junk. If a second threshold, higher than the first threshold, is detected, it may be evidence that the junk recovery tool 100 is filling up and that the junk recovery tool 100 will need to be emptied soon. If a third threshold, higher than both the first and second thresholds, is detected, it may be evidence that the junk recovery tool 100 is full. In such a scenario, if the third threshold is reached, the junk recovery tool 100 may need to be removed from the wellbore 201 to be checked and/or emptied. The non-transitory electronic memory 332 may include any other additional or alternative instructions for components of the junk recovery tool 100 as one skilled in the art would appreciate.

The processor 330 may be any device capable of executing machine-readable instructions. For example, the processor 330 may be an integrated circuit, a microchip, a computer, or any other computing device. The non-transitory electronic memory 332 and the processor 330 are coupled to the communication path 335 that provides signal interconnectivity between various components and/or modules of the detection system 300. Accordingly, the communication path 335 may communicatively couple any number of processors with one another, and allow the modules coupled to the communication path 335 to operate in a distributed computing environment. Specifically, each of the modules may operate as a node that may send and/or receive data. As used herein, the term "communicatively coupled" means that coupled components are capable of exchanging data signals with one another such as, for example, electrical signals via conductive medium, electromagnetic signals via air, optical signals via optical waveguides, and the like. As schematically depicted in FIG. 3, the communication path 335 communicatively couples the processor 330 and the non-transitory electronic memory 332 with a plurality of other components of the detection system 300.

The detection system 300 may also include network interface hardware 336 for communicatively coupling the detection system 300 to a portable device 340 via a network 320. The portable device 340 may include, without limitation, a laptop, a smartphone, a tablet, a personal media player, or any other electronic device that includes wireless communication functionality. The portable device 340 may be used to provide supplemental notification of a detected pressure in the junk recovery tool 100.

The present disclosure is also directed to methods for recovering junk in a wellbore 201. Referring again to FIGS. 1 and 2, a method for recovering junk in a wellbore 201 may include circulating a drilling fluid comprising junk through a junk recovery tool 100 and passing at least a portion of the drilling fluid comprising junk through a plurality of junk recovery baskets 104 spaced apart and attached to a longitudinal axial mandrel 102 of the junk recovery tool 100. A first one 104A of the junk recovery baskets 104 may be disposed uphole of a second one 104B of the junk recovery baskets 104. Each of the junk recovery baskets 104 may comprise a plurality of apertures 108. The apertures 108 may each have an opening size. The plurality of apertures 108 of the first one 104A of the junk recovery baskets 104 may comprise a different opening size than the plurality of apertures 108 of a second one 104B of the junk recovery baskets 104. The method may also include filtering at least a portion of junk from the drilling fluid as the drilling fluid passes through the plurality of junk recovery baskets 104 of the junk recovery tool 100.

The junk recovery tool 100 employed in the methods for recovering junk in a wellbore 201 may include any feature, function, or characteristic as previously described in the present disclosure.

The method may further include monitoring an amount of collected junk in one of the plurality of junk recovery baskets 104. Additionally or alternatively, the method may further include monitoring a type of fluid in one of the plurality of junk recovery baskets 104.

Monitoring an amount of collected junk or a type of fluid in one of the plurality of junk recovery baskets 104 may be accomplished using at least one junk recovery sensor 106. The at least one junk recovery sensor 106 employed in the methods for recovering junk in a wellbore 201 may include any feature, function, or characteristic as previously described in the present disclosure.

One or more aspects of the present disclosure are described here. A first aspect of the present disclosure may include a junk recovery tool for a wellbore having a longitudinal axial mandrel, a plurality of junk recovery baskets, and at least one junk recovery sensor. The plurality of junk recovery baskets may be spaced apart and attached to the longitudinal axial mandrel. A first one of the junk recovery baskets may be disposed uphole of a second one of the junk recovery baskets. Each of the junk recovery baskets may include a plurality of apertures to allow a drilling fluid to pass through the junk recovery basket while collecting junk from the drilling fluid. The plurality of apertures may each have an opening size. The plurality of apertures of the first one of the junk recovery baskets may have a different opening size than the plurality of apertures of the second one of the junk recovery baskets. The at least one junk recovery sensor may be disposed in one of the plurality of junk recovery baskets. The at least one junk recovery sensor may be operable to measure an amount of collected junk in the one of the plurality of junk recovery baskets.

A second aspect of the present disclosure may include the first aspect, wherein the plurality of junk recovery baskets comprise an outer wall, at least a partially open top, and a bottom, where at least a portion of the plurality of apertures are defined in the bottom of the plurality of junk recovery baskets.

A third aspect of the present disclosure may include either the first or second aspect, wherein the junk recovery tool for the wellbore further comprises a third of the junk recovery baskets being disposed downhole of the first one of the junk recovery baskets and uphole of the second one of the junk recovery baskets.

A fourth aspect of the present disclosure may include the third aspect, wherein the plurality of apertures of the third junk recovery basket comprise a smaller opening size than the first one of the junk recovery baskets and a larger opening size than the second one of the junk recovery baskets.

A fifth aspect of the present disclosure may include any one of the first through fourth aspects, wherein the plurality of apertures of individual ones of the plurality of junk recovery baskets comprise a uniform opening size.

A sixth aspect of the present disclosure may include any one of the first through fifth aspects, wherein the plurality of apertures are round openings having a diameter.

A seventh aspect of the present disclosure may include the sixth aspect, wherein the diameter of the plurality of apertures ranges from greater than or equal to 0.03125 inches (0.08 centimeters) to less than or equal to 2 inches (5 centimeters).

An eighth aspect of the present disclosure may include any one of the first through seventh aspects, A ninth aspect of the present disclosure may include any one of the first through ninth aspects, wherein the at least one junk recovery sensor comprises a weight sensor, a level sensor, or a fluid-type sensor.

A tenth aspect of the present disclosure may include any one of the first through ninth aspects, wherein the at least one junk recovery sensor comprises a weight sensor positioned at or near the bottom of the plurality of junk recovery baskets; and the weight sensor is operable to measure an amount of junk collected in one of the plurality of junk recovery baskets.

An eleventh aspect of the present disclosure may include any one of the first through tenth aspects, wherein the at least one junk recovery sensor comprises a fluid-type sensor operable to determine the type of fluid in the one of the plurality of junk recovery baskets.

A twelfth aspect of the present disclosure may include any one of the first through eleventh aspects, wherein the junk recovery tool for the wellbore comprises a first junk recovery sensor disposed in the first one of the junk recovery baskets and a second junk recovery sensor disposed in the second one of the junk recovery baskets.

A thirteenth aspect of the present disclosure may include any one of the first through twelfth aspects, wherein the junk recovery tool for the wellbore comprises a plurality of junk recovery sensors disposed in each of the plurality of junk recovery baskets.

A fourteenth aspect of the present disclosure may include a system for recovering junk in a wellbore having a drilling tool and a junk recovery tool. The drilling tool may include a drilling fluid source, a drill string, and a drill bit. The drilling tool may have a length and the drill bit may define a downhole end of the length of the drilling tool. The drilling fluid source may be operable to store a drilling fluid. The drill string may include a drilling tool longitudinal axial mandrel extending the length of the drill string. The drill string may couple the drilling fluid source to the drill bit. The drill string may be operable to transport the drilling fluid stored in the drilling fluid source along the drilling tool longitudinal axial mandrel to the drill bit. The junk recovery tool may include a longitudinal axial mandrel, a plurality of junk recovery baskets and at least one junk recovery sensor. The junk recovery tool may be positioned along the drill string and above the drill bit. The drilling tool longitudinal axial mandrel of the drill string may be in fluid communication with the longitudinal axial mandrel of the junk recovery tool. The plurality of junk recovery baskets may be spaced apart and attached to the longitudinal axial mandrel of the junk recovery tool. A first one of the junk recovery baskets may be disposed uphole of a second one of the junk recovery baskets. Each of the plurality of junk recovery baskets may have a plurality of apertures to allow the drilling fluid to pass through the junk recovery baskets while collecting junk from the drilling fluid. The plurality of apertures may each have an opening size. The plurality of apertures of the first one of the junk recovery baskets may have a differing opening size than the plurality of apertures of the second one of the junk recovery baskets. The at least one junk recovery sensor may be disposed in one of the plurality of junk recovery baskets. The at least one junk recovery sensor may be operable to measure an amount of collected junk in the one of the plurality of junk recovery baskets.

A fifteenth aspect of the present disclosure may include the fourteenth aspect, wherein the plurality of junk recovery baskets comprise an outer wall, at least a partially open top, and a bottom, where at least a portion of the plurality of apertures are defined in the bottom of the plurality of junk recovery baskets.

A sixteenth aspect of the present disclosure may include either the fourteenth or fifteenth aspect, wherein the plurality of apertures of individual ones of the plurality of junk recovery baskets comprise a uniform opening size.

A seventeenth aspect of the present disclosure may include any one of the fourteenth through sixteenth aspects, wherein the at least one junk recovery sensor comprises a weight sensor, a level sensor, or a fluid-type sensor.

An eighteenth aspect of the present disclosure may include a method for recovering junk in a wellbore. The method may include circulating a drilling fluid comprising junk through a junk recovery tool and passing at least a portion of the drilling fluid comprising junk through a plurality of junk recovery baskets spaced apart and attached to a longitudinal axial mandrel of the junk recovery tool. A first one of the junk recovery baskets may be disposed uphole of a second one of the junk recovery baskets. Each of the junk recovery baskets may include a plurality of apertures. The apertures may each have an opening size. The plurality of apertures of the first one of the junk recovery baskets may have a different opening size than the plurality of apertures of the second one of the junk recovery baskets. The method may also include filtering at least a portion of junk from the drilling fluid as the drilling fluid passes through the plurality of junk recovery baskets of the junk recovery tool.

A nineteenth aspect of the present disclosure may include the eighteenth aspect, further comprising monitoring an amount of collected junk in one of the plurality of junk recovery baskets.

A twentieth aspect of the present disclosure may include either the eighteenth or nineteenth aspect, further comprising monitoring a type of fluid in one of the plurality of junk recovery baskets.

It is also noted that recitations herein of "at least one" component, element, etc., should not be used to create an inference that the alternative use of the articles "a" or "an" should be limited to a single component, element, etc. For example, the use of "at least one fluid control valve" should not be interpreted to mean that the wellhead can only include one fluid control valve.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A junk recovery tool for a wellbore, the junk recovery tool comprising:

a longitudinal axial mandrel;

a plurality of junk recovery baskets; and at least one junk recovery sensor, wherein the plurality of junk recovery baskets are spaced apart and attached to the longitudinal axial mandrel, a first one of the junk recovery baskets being disposed uphole of a second one of the junk recovery baskets;

each of the junk recovery baskets comprise a plurality of apertures to allow a drilling fluid to pass through the junk recovery basket while collecting junk from the drilling fluid, the plurality of apertures each having an opening size;

the plurality of apertures of the first one of the junk recovery baskets comprise a different opening size than the plurality of apertures of the second one of the junk recovery baskets;

the at least one junk recovery sensor is disposed in one of the plurality of junk recovery baskets and is operable to measure an amount of collected junk in the one of the plurality of junk recovery baskets;

the junk recovery tool for the wellbore further comprises a third one of the junk recovery baskets being disposed downhole of the first one of the junk recovery baskets and uphole of the second one of the junk recovery baskets; and the plurality of apertures of the third one of the junk recovery basket comprise a smaller opening size than the first one of the junk recovery baskets and a larger opening size than the second one of the junk recovery baskets.

2. The junk recovery tool of claim 1, wherein the plurality of junk recovery baskets comprise an outer wall, at least a partially open top, and a bottom, where at least a portion of the plurality of apertures are defined in the bottom of the plurality of junk recovery baskets.

3. The junk recovery tool of claim 1, wherein the plurality of apertures of individual ones of the plurality of junk recovery baskets comprise a uniform opening size.

4. The junk recovery tool of claim 1, wherein the plurality of apertures are round openings having a diameter.

5. The junk recovery tool of claim 4, wherein the diameter of the plurality of apertures ranges from greater than or equal to 0.03125 inches (0.08 centimeters) to less than or equal to 2 inches (5 centimeters).

6. The junk recovery tool of claim 1, wherein the at least one junk recovery sensor comprises a weight sensor or a level sensor.

7. The junk recovery tool of claim 1, wherein:

the at least one junk recovery sensor comprises a weight sensor positioned at or near the bottom of the plurality of junk recovery baskets; and the weight sensor is operable to measure the amount of junk collected in one of the plurality of junk recovery baskets.

8. The junk recovery tool of claim 1, the at least one junk recovery sensor comprises a level sensor positioned at or near the top of the plurality of junk recovery baskets; and the level sensor is operable to measure the amount of junk collected in one of the plurality of junk recovery baskets.

9. The junk recovery tool of claim 1, wherein the at least one junk recovery sensor comprises a fluid-type sensor operable to determine the type of fluid in the one of the plurality of junk recovery baskets.

10. The junk recovery tool of claim 1, wherein the junk recovery tool for the wellbore comprises a first junk recovery sensor disposed in the first one of the junk recovery baskets and a second junk recovery sensor disposed in the second one of the junk recovery baskets.

11. The junk recovery tool of claim 1, wherein the junk recovery tool for the wellbore comprises a plurality of junk recovery sensors disposed in each of the plurality of junk recovery baskets.

12. A system for recovering junk in a wellbore, the system comprising a drilling tool and a junk recovery tool, wherein:

the drilling tool comprises a drilling fluid source, a drill string, and a drill bit, the drilling tool comprising a length and the drill bit defining a downhole end of the length of the drilling tool;

the drilling fluid source is operable to store a drilling fluid;

the drill string comprises a drilling tool longitudinal axial mandrel extending the length of the drill string;

the drill string couples the drilling fluid source to the drill bit and is operable to transport the drilling fluid stored in the drilling fluid source along the drilling tool longitudinal axial mandrel to the drill bit;

the junk recovery tool comprises a longitudinal axial mandrel, a plurality of junk recovery baskets and at least one junk recovery sensor;

the junk recovery tool is positioned along the drill string and above the drill bit;

the drilling tool longitudinal axial mandrel of the drill string is in fluid communication with the longitudinal axial mandrel of the junk recovery tool;

the plurality of junk recovery baskets are spaced apart and attached to the longitudinal axial mandrel of the junk recovery tool, a first one of the junk recovery baskets being disposed uphole of a second one of the junk recovery baskets;

a third one of the junk recovery baskets is disposed downhole of the first one of the junk recovery baskets and uphole of the second one of the junk recovery baskets; and each of the plurality of junk recovery baskets comprise a plurality of apertures to allow the drilling fluid to pass through the junk recovery baskets while collecting junk from the drilling fluid, the plurality of apertures each having an opening size;

the plurality of apertures of the first one of the junk recovery baskets comprise a differing opening size than the plurality of apertures of the second one of the junk recovery baskets;

the plurality of apertures of the third one of the junk recovery basket comprise a smaller opening size than the first one of the junk recovery baskets and a larger opening size than the second one of the junk recovery baskets; and the at least one junk recovery sensor is disposed in one of the plurality of junk recovery baskets and is operable to measure an amount of collected junk in the one of the plurality of junk recovery baskets.

13. The system of claim 12, wherein the plurality of junk recovery baskets comprise an outer wall, at least a partially open top, and a bottom, where at least a portion of the plurality of apertures are defined in the bottom of the plurality of junk recovery baskets.

14. The system of claim 12, wherein the plurality of apertures of individual ones of the plurality of junk recovery baskets comprise a uniform opening size.

15. The system of claim 12, wherein the at least one junk recovery sensor comprises a weight sensor, a level sensor, or a fluid-type sensor operable to determine the type of fluid in the one of the plurality of junk recovery baskets.

16. A method for recovering junk in a wellbore, the method comprising:

circulating a drilling fluid comprising junk through a junk recovery tool;

passing at least a portion of the drilling fluid comprising junk through a plurality of junk recovery baskets spaced apart and attached to a longitudinal axial mandrel of the junk recovery tool, wherein a first one of the junk recovery baskets is disposed uphole of a second one of the junk recovery baskets;

a third one of the junk recovery baskets is disposed downhole of the first one of the junk recovery baskets and uphole of the second one of the junk recovery baskets;

each of the junk recovery baskets comprise a plurality of apertures, the apertures each having an opening size;

the plurality of apertures the first one of the junk recovery baskets comprise a different opening size than the plurality of apertures of the second one of the junk recovery basket;

the plurality of apertures of the third one of the junk recovery basket comprise a smaller opening size than the first one of the junk recovery baskets and a larger opening size than the second one of the junk recovery baskets; and filtering at least a portion of junk from the drilling fluid as the drilling fluid passes through the plurality of junk recovery baskets of the junk recovery tool.

17. The method of claim 16, further comprising monitoring an amount of collected junk in one of the plurality of junk recovery baskets.

18. The method of claim 16, further comprising monitoring a type of fluid in one of the plurality of junk recovery baskets.

* * * * *